US008991107B2

(12) United States Patent
Ferrari

(10) Patent No.: US 8,991,107 B2
(45) Date of Patent: Mar. 31, 2015

(54) MAST FOR DRILLING RIGS AND METHODS OF ASSEMBLING THE SAME

(71) Applicant: Drillmec SpA, Gariga di Podenzano (IT)

(72) Inventor: Stefano Ferrari, Gariga di Podenzano (IT)

(73) Assignee: Drillmec S.p.A., Gariga di Podenzano (PC) (IT)

( * ) Notice: Subject to any disclaimer, the term of this patent is extended or adjusted under 35 U.S.C. 154(b) by 0 days.

(21) Appl. No.: 13/645,203

(22) Filed: Oct. 4, 2012

(65) Prior Publication Data

US 2013/0180185 A1 Jul. 18, 2013

(30) Foreign Application Priority Data

Oct. 4, 2011 (IT) ..... TO2011A0883

(51) Int. Cl.
*E21B 15/00* (2006.01)
*E21B 7/02* (2006.01)
*E04H 12/18* (2006.01)

(52) U.S. Cl.
CPC ..... *E21B 15/00* (2013.01); *E21B 7/023* (2013.01)
USPC ..... 52/117; 52/115; 52/632; 52/651.05

(58) Field of Classification Search
CPC ..... E21B 7/022; E21B 7/023
USPC ..... 52/115, 116, 117, 118, 121, 632, 52/651.05; 175/162, 203; 212/294, 297, 212/298
See application file for complete search history.

(56) References Cited

U.S. PATENT DOCUMENTS

| | | | | | |
|---|---|---|---|---|---|
| 848,304 | A | * | 3/1907 | Hines | 52/120 |
| 2,176,965 | A | | 10/1939 | Haynes | |
| 2,225,561 | A | * | 12/1940 | Henry | 52/120 |
| 2,413,149 | A | * | 12/1946 | McCarthy et al. | 52/119 |
| 2,835,358 | A | * | 5/1958 | Lusum | 52/697 |
| 2,847,097 | A | * | 8/1958 | Moore | 52/120 |
| 2,982,379 | A | * | 5/1961 | Fisher | 52/111 |
| RE25,010 | E | * | 7/1961 | Poetker | 52/119 |
| 3,011,586 | A | * | 12/1961 | Harvey, Jr. | 182/115 |
| 3,802,137 | A | * | 4/1974 | Armstrong | 52/118 |
| 4,393,630 | A | * | 7/1983 | Knox | 52/121 |
| 4,604,844 | A | * | 8/1986 | Mikulas et al. | 52/632 |
| 4,725,179 | A | * | 2/1988 | Woolslayer et al. | 414/22.65 |
| 4,958,474 | A | * | 9/1990 | Adams | 52/646 |

(Continued)

OTHER PUBLICATIONS

Italian Search Report for Italian Application No. TO20110883 May 11, 2012.

*Primary Examiner* — Charles A Fox
*Assistant Examiner* — Joseph J Sadlon
(74) *Attorney, Agent, or Firm* — Merchant & Gould P.C.

(57) ABSTRACT

A reclosable mast (2) for drilling rig includes two opposed latticed structures (22), constrained at one end to the base structure (10) placed in the drilling site "P" and to each other, defining side faces (2*b*) of the mast (2). U-shaped structures, each include a rear bar (40), adapted to get compressed when closing the mast (2), and two side shoulders (41) parallel to each other and perpendicular to the an associated bar (40). The U-shaped structures are arranged at preset intervals between the two latticed structures (22), the rear bars defining the rear face or back (2*a*) of the mast (2). The mast (2) includes a diagonal members (3) located on the rear face 2*a* of the mast and constrained, between two superimposed U-shaped structures, the diagonal members (3) being adapted to split into at least two portions; reducing their longitudinal extension, and to allow reducing the dimension.

15 Claims, 7 Drawing Sheets

(56) References Cited

U.S. PATENT DOCUMENTS

| | | | | |
|---|---|---|---|---|
| 5,040,349 | A * | 8/1991 | Onoda et al. | 52/646 |
| 5,718,345 | A * | 2/1998 | Hade, Jr. | 212/349 |
| 5,845,451 | A * | 12/1998 | Tolentino | 52/646 |
| 6,594,960 | B2 | 7/2003 | Brittain et al. | |
| 7,716,897 | B2 * | 5/2010 | Merrifield | 52/651.1 |
| 8,112,946 | B2 * | 2/2012 | Vogt | 52/116 |
| 8,316,588 | B2 * | 11/2012 | Cicognani | 52/118 |
| 8,613,176 | B2 * | 12/2013 | Daas et al. | 52/645 |
| 8,813,436 | B2 * | 8/2014 | Donnally et al. | 52/123.1 |
| 2006/0251454 | A1 * | 11/2006 | Ashton et al. | 400/1 |
| 2006/0278394 | A1 * | 12/2006 | Stover | 166/308.1 |
| 2011/0120043 | A1 * | 5/2011 | Vogt | 52/646 |

* cited by examiner

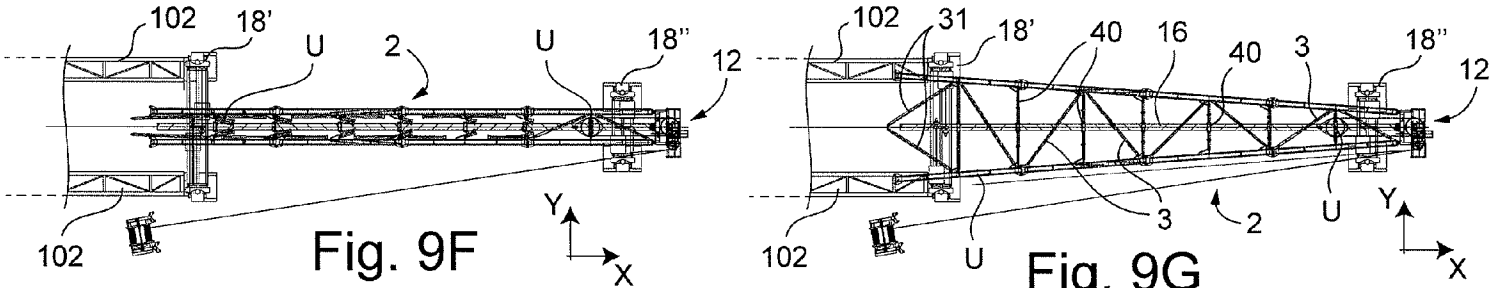
Fig. 9F
Fig. 9G
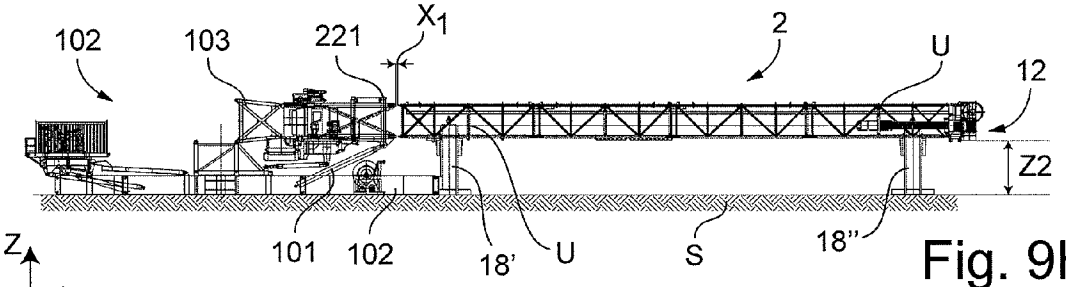
Fig. 9H
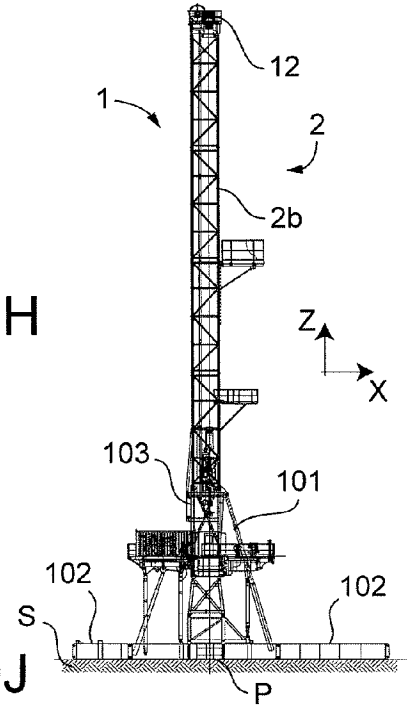
Fig. 9J
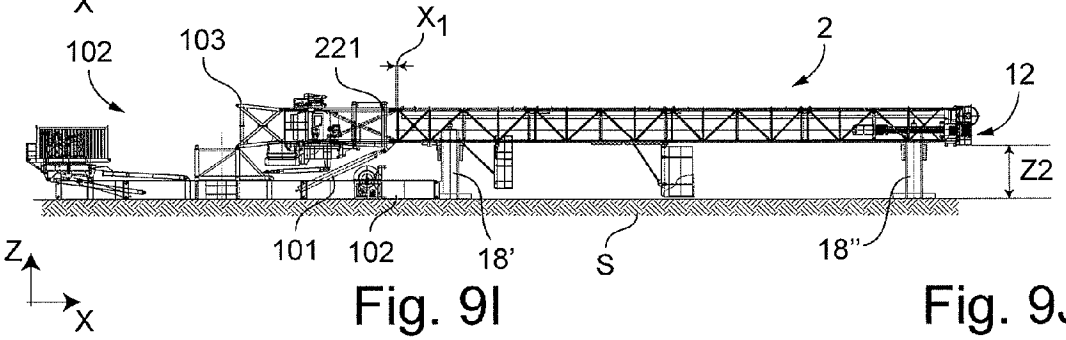
Fig. 9I

MAST FOR DRILLING RIGS AND METHODS OF ASSEMBLING THE SAME

This application claims benefit of Serial No. TO2011A000883, filed 4 Oct. 2011 in Italy and which application is incorporated herein by reference. To the extent appropriate, a claim of priority is made to the above disclosed application.

BACKGROUND

The present invention relates to a reclosable mast comprised in a drilling rig for excavating extraction wells, e.g. oil wells.

Said rig is suitable for use on the ground and can be transported from one location to another by means of trucks and semitrailers.

Said rig normally comprises a mast, a substructure, a hoist and a structure for supporting the vertical or setback drill pipes.

Said substructure is made up of base elements resting on the ground, which is leveled and compacted prior to installing the rig; a central structure at the centre of the well, essentially consisting of two strong shoulders; a latticed structure consisting of two side shoulders and a back, with the fourth side left open. Said latticed structure comprises beams for supporting the rotary table, and the structure for supporting the vertical or setback drill pipes. In addition, said latticed structure is hinged to the base elements and can rotate by 90°, e.g. from horizontal to vertical, and vice versa.

At the top of said latticed structure there are a plurality of connectors, e.g. double-hinged ones, for securing the mast.

There are also connection elements for lifting means used for erecting the assembled mast, once the assembly is completed, e.g. two hydraulic cylinders.

The structure that supports the vertical drill pipes and the beams that support the rotary table are hinged to the substructure, normally at the front leg of the lattice. Said setback and rotary table beams remain substantially horizontal, and take their final configuration when the mast is in the vertical position.

The hoist frame is an articulated parallelogram.

In the final installed position, the hoist frame is secured to the floor where drilling will take place.

The mast has a three-sided latticed structure, in particular with two side shoulders and a back, the fourth side being open. Normally these masts can be divided into a plurality of portions, e.g. four, such as an upper portion, also comprising portions of the hoist, the upper intermediate portion, the lower intermediate portion and the lower portion.

The ground is drilled by means of specific drilling equipment, called "top drive", comprising at least one drill head slideable on guides which are normally installed on the back of the mast lattice.

The upward/downward motion of said top drive and of the drill string constrained thereto is ensured by a handling system comprising a winding drum, a line, a plurality of pulleys, whereon said line is suitably arranged, and a backup line spooler.

Since the line is subject to wear against the pulleys, it is common practice to pull the line from the spooler and cut it at regular intervals, expressed in tonkm or tonmiles.

Normally the mast in the extended configuration has a nominal distance between its shoulders of 9.144 m and a maximum dimension of 9.16 m. These characteristics ensure sufficient room on the drill floor and very good visibility of the top drive.

The on-site installation of the drilling rig is completed by adding gangways and ladders, a BOP system, and the drill pipe loader.

The above-mentioned drilling rig is normally used for excavating wells which are relatively not very deep, and which require an average installation time of approximately one month. As a consequence, at regular intervals of about one month it is necessary to disassemble said rig, transport it, and reposition it where a new wellbore is to be drilled.

When transporting the rig, in particular in highly urbanized areas, e.g. near towns, it is necessary to solve a problem related to the width of the mast structure, so as to be allowed to drive on two-way two-lane state highways and county roads.

In such cases, an exceptional transportation needs to be arranged, wherein the route must be approved and authorized by the road authorities.

To reduce the cost and time necessary for obtaining the required authorizations, it is necessary that the maximum transversal width of the mast is 3.3 m, so that it can be transported with the aid of a technical escort alone including a car and authorized personnel, without requiring the intervention of the highway police.

Masts are known which can be dismounted and reclosed in order to reduce their dimensions.

Said masts can be disassembled into a plurality of sections. Said mast is divided into sections prior to transportation, and the lateral dimension of the back thereof is reduced in every single section.

In order to take less room, said masts must be divided into sections before they can be reclosed.

U.S. Pat. No. 6,594,960 describes a mast which can be divided into four portions, and which is then reclosed by releasing rear bars forming the back of the mast; the rear bars can be folded through manual means only after the mast has been divided into four portions.

When closing the back of the mast, the rear bars fold up and occupy a portion of the mast structure that, when in use, is occupied by the drilling equipment or top drive. In said mast, the top drive must be removed before one can carry out the mast closing operation.

United States patent application US2011120043 is also known, which describes a sectionable mast whose sections can be brought into a closed configuration.

In both of these prior-art solutions, assembling and disassembling said masts, e.g. in view of transporting them to other drilling locations, require excessive time because of the complexity of the structure and the large number of constrained members that must be fastened or released for properly assembling/disassembling the mast; in fact, in order to properly assemble/disassemble the mast it is necessary to constrain/release a large number of fastening elements included in each mast section.

As a matter of fact, the various sections of the mast must be assembled after having been extended, thus taking up more space and making the parts more difficult to connect.

Furthermore, such masts require much manual work by the personnel in charge for opening/closing the mast, because the various sections must be opened or closed manually through the use of ropes or suitable bars.

In addition to being difficult to assemble/disassemble, these masts are complex to manufacture and excessively costly due to the large number of constraining members. Also, the mast sections are very delicate because, due to their very complex structure, they very often get stuck while switching from the open configuration to the closed configuration, which may result in damage to the components of the mast structure.

The problem to be solved is, therefore, to articulate the elements of the back of the mast in a manner such that the shoulders can be brought near each other within the specified dimension of 3.3 m, by using a simplified mast structure.

Furthermore, it is desirable to provide a mast which can be easily assembled to the drilling rig, by making the assembly steps simpler and automated.

The present invention aims at overcoming the above-mentioned problems by providing a mast that can be closed to take up less room, and can possibly be divided into a plurality of sections to make transportation easier thanks to the reduced transversal dimension of the mast itself.

Moreover, the operations for assembling the mast sections are carried out with the sections closed, i.e. smaller, thereby facilitating the operations for constraining the various parts thereof.

In particular, the mast structure is simplified, thereby facilitating the construction of the mast components and the operations for opening and closing the mast.

SUMMARY

One aspect of the present invention relates to a mast for drilling rigs having the features set out in the appended claim 1.

A further aspect of the present invention relates to a method of assembling the mast.

BRIEF DESCRIPTION OF THE DRAWINGS

The features and advantages of the mast for drilling rigs according to the present invention will become more apparent and evident from the following description of an exemplary embodiment and from the annexed drawings, wherein:

FIG. 1A shows the mast comprised in a drilling rig, FIG. 1B shows a front view of the mast; FIG. 1C shows a side view of the mast;

FIGS. 2A, 2B, 2C and 2D show top views at different increasing heights and FIG. 2E shows a detail of a U-shaped structure;

FIG. 3A shows the mast in the open operating configuration and FIG. 3B shows the mast in the closed configuration;

FIG. 4A shows a side view of said portion and FIG. 4B shows an inclined front view of said portion;

FIG. 5A shows a side view of said portion and FIG. 5B shows an inclined front view of said portion;

FIG. 6A shows a side view of said portion and FIG. 6B shows an inclined front view of said portion;

FIG. 7A shows a side view of said portion and FIG. 7B shows an inclined front view of said portion;

FIGS. 9A, 9B, 9C, 9D, 9E, 9F, 9G, 9H, 9I, 9J show the sequential steps of assembling the mast to the drilling rig.

DETAILED DESCRIPTION

Figure 1C:
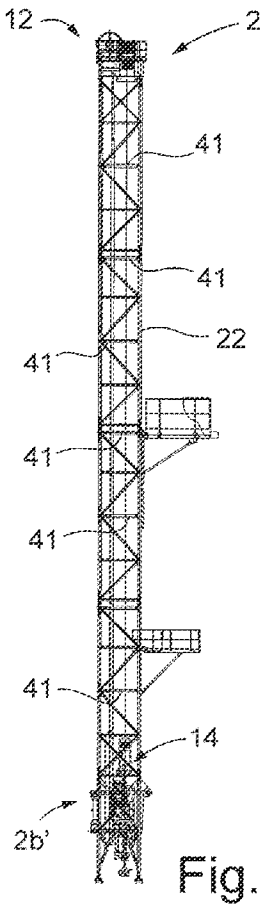
FIGS. 1A, 1B and 1C show different views, respectively, of the mast according to the present invention.
Figure 1B:
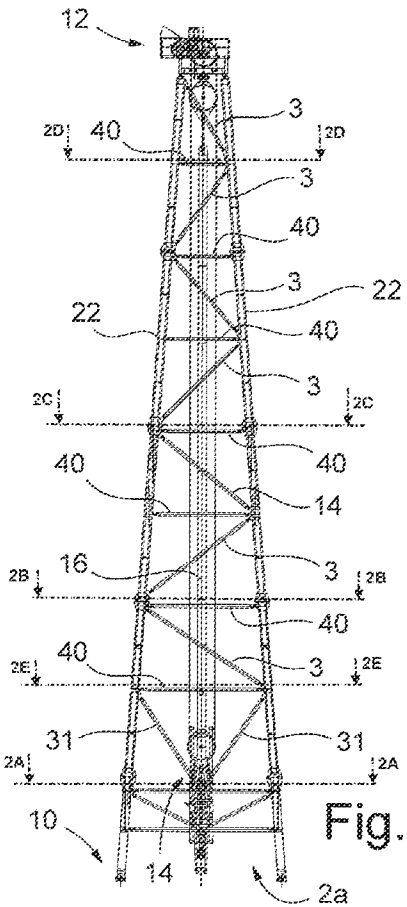
Figure 1A:
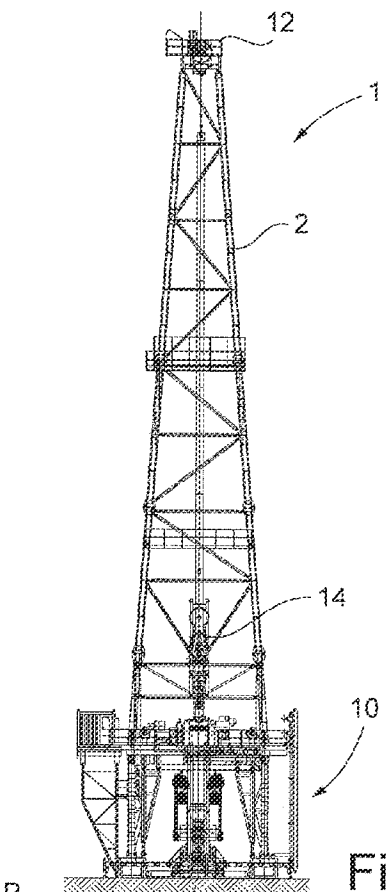
Figure 2A:
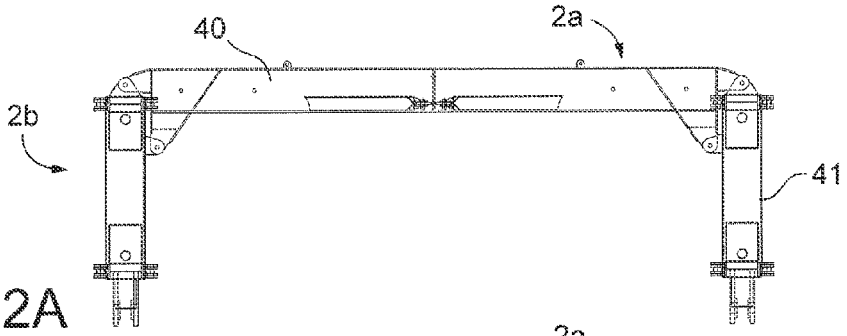
FIGS. 2A, 2B, 2C, 2D and 2E show five sections of the mast of FIGS. 1A and 1B; in particular.
Figure 2B:
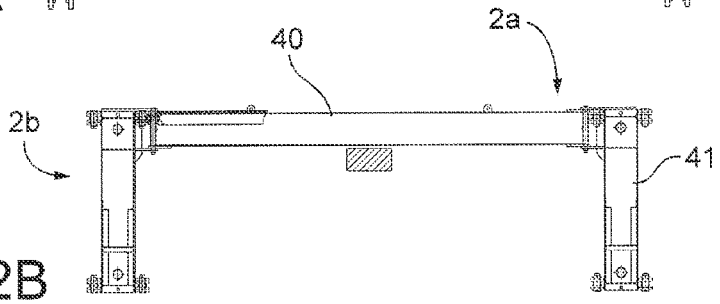
Figure 2C:
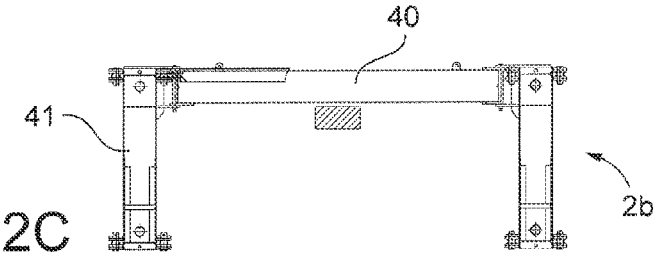
Figure 2D:
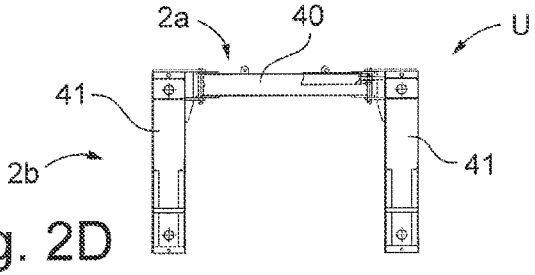
Figure 2E:
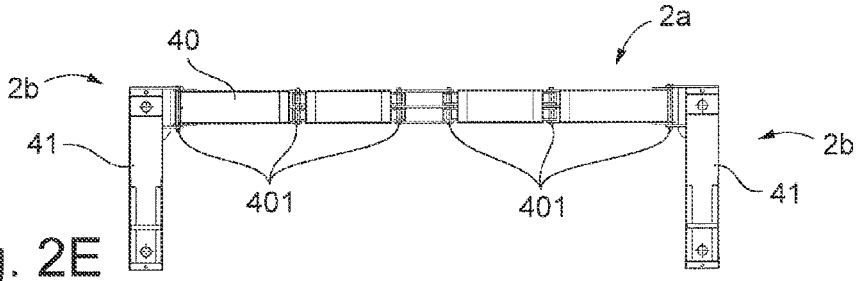
Figure 3A:
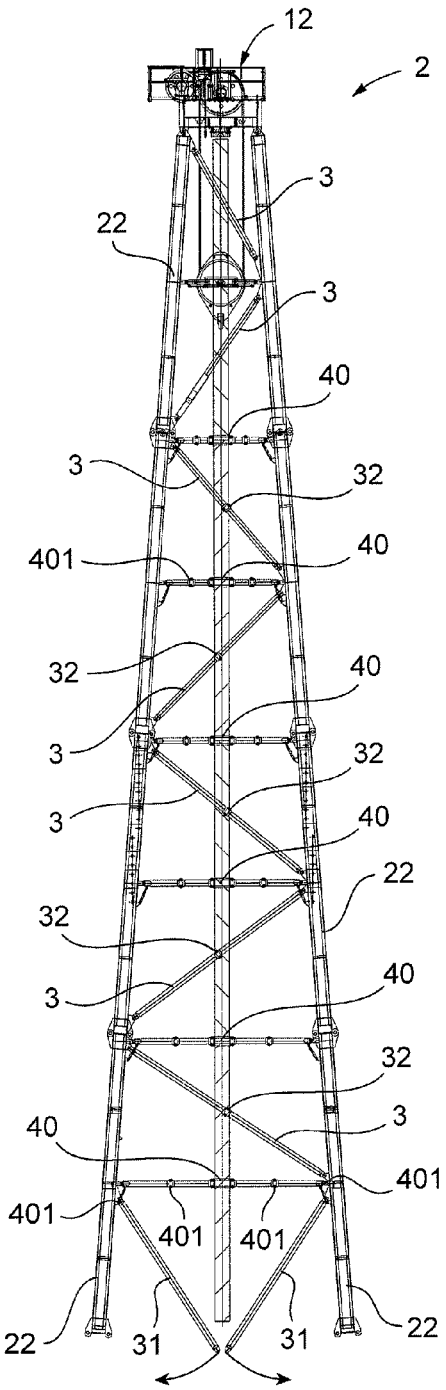
FIGS. 3A, 3B show front views of the mast in different operating configurations; in particular.
Figure 3B:
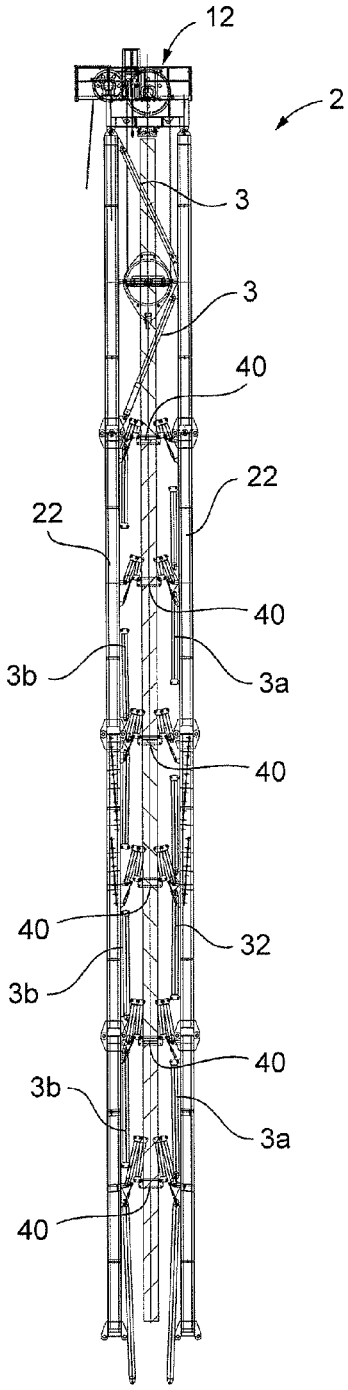
Figure 4A:
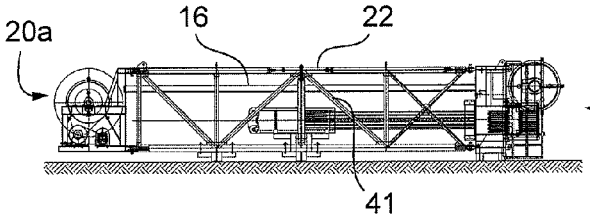
FIGS. 4A and 4B show the upper portion of the mast of the sectionable embodiment in the closed configuration; in particular.
Figure 4B:
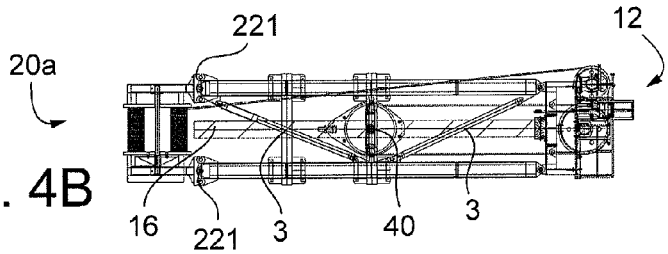
Figure 5A:
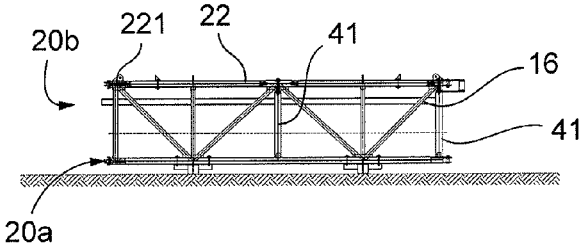
FIGS. 5A and 5B show the upper intermediate portion of the mast of the sectionable embodiment in the closed configuration; in particular.
Figure 5B:
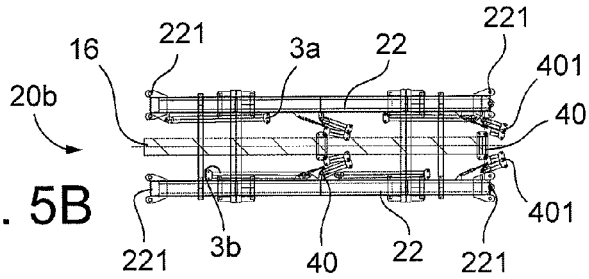
Figure 6A:
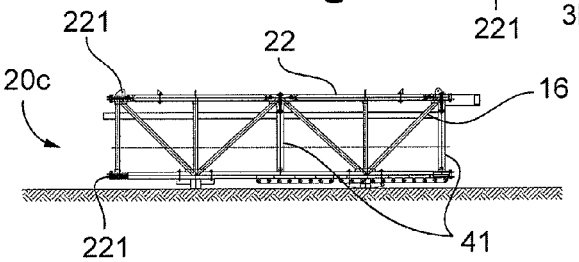
FIGS. 6A and 6B show the lower intermediate portion of the mast of the sectionable embodiment in the closed configuration; in particular.
Figure 6B:
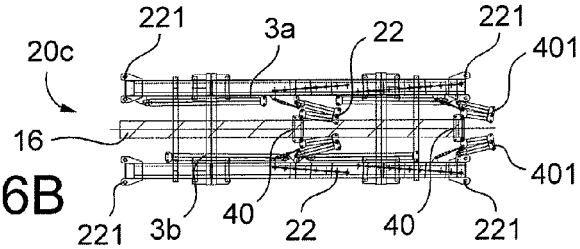
Figure 7A:
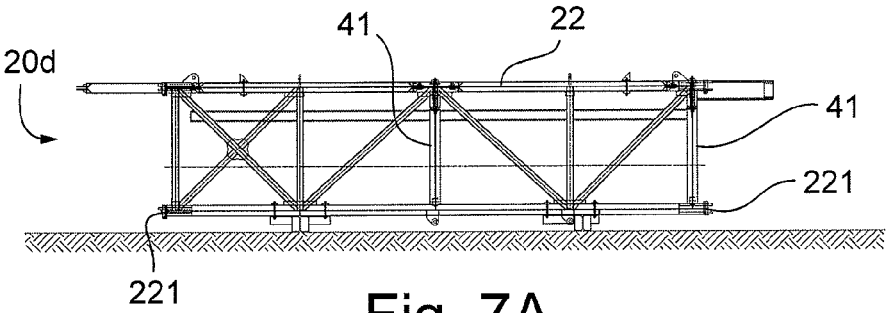
FIGS. 7A and 7B show the lower portion of the mast of the sectionable embodiment in the closed configuration; in particular.
Figure 7B:
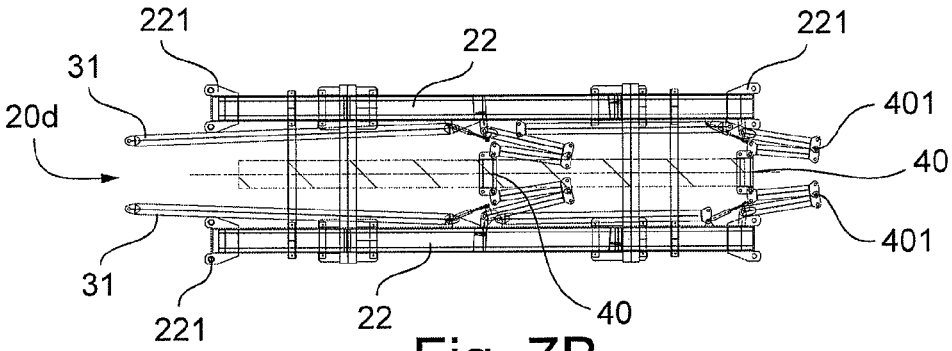

With reference to the above drawings, reclosable mast 2, comprised in a drilling rig 1, comprises two opposed latticed structures 22, which are constrained at one end to base structure 10 placed on a drilling site "P" on ground "S" and at the opposite end to each other, thus defining side faces 2*b* of mast 2.

Preferably, said latticed structures 22 are constrained to the external structure of a handling system 12 adapted to actuate the drilling devices or top drive 14, which are adapted to drill a wellbore in drilling site "P". Furthermore, each one of said latticed structures 22 comprises a front leg and a rear leg.

Said mast 2 comprises a plurality of U-shaped structures, each comprising a rear bar 40, adapted to get compressed when closing mast 2, and two side shoulders 41 parallel to each other and perpendicular to said bar 40, with which they are associated.

Said U-shaped structures are arranged at preset intervals between the two latticed structures 22, so that said rear bars define a rear face or back 2*a* of mast 2.

Said mast 2 further comprises a plurality of diagonal members 3, located on rear face 2*a* of the mast and constrained, when in use, between two superimposed U-shaped structures. Preferably, each one of said diagonal members 3 is removably constrained between two consecutive superimposed U-shaped structures.

In order to allow reducing the transversal dimension of rear face 2*a* of mast 2, said diagonal members 3 are adapted to split into at least two portions to reduce their longitudinal extension.

Said diagonal members 3, which are adapted to reduce their longitudinal extension, are telescopic. Preferably, diagonal members 2 of this type are arranged between U-shaped structures located at the upper end of the mast.

Said rear bar 40 comprised in each U-shaped structure of said upper portion of mast 2 is telescopic and is adapted to get compressed as mast 2 is being closed.

Instead, said splittable diagonal members 3 comprise at least one constraining member 32, which is adapted to, when in use, removably fix the portions of diagonal member 3 itself. Preferably, diagonal members 3 of this type are placed between U-shaped structures located at the lower end of mast 2. When said diagonal members 3 are disconnected at the centre, the two portions 3*a* and 3*b* are brought into the transportation position, parallel to the rear legs of latticed structure 22.

Preferably, said at least one constraining member 32 is of the double-hinge type and is located at the centre of diagonal member 3 itself.

In said lower portion of mast 2, said rear bar 40 comprised in the U-shape structures is articulated and comprises at least three hinge points 401 adapted to allow for accordion-type compression of bar 40 when closing mast 2. When it is compressed, said bar 40 arranges itself on the surface defined by rear face 2*a* of mast 2.

Preferably, said hinge points are double hinges; furthermore, as shown in the drawings, said hinge points 401 are six and are adapted to connect five elements to each other and to the structure of mast 2. Said five elements, thanks to said hinge points 401, arrange themselves in an accordion-like fashion when said mast 2 is closed. Preferably, the central element of rear bar 40 is constrained to a vertical beam 16 adapted to guide the movement of the drilling devices or top drive 14; instead, the elements adjacent to the central element of rear bar 40 articulate themselves, thanks to hinge points 401, into an accordion-like shape.

In general, at least one actuator 43 is associated with each U-shaped structure, which actuator is adapted to contribute to the extension/compression of rear bar 40 for opening/closing mast 2.

Figure 8A:
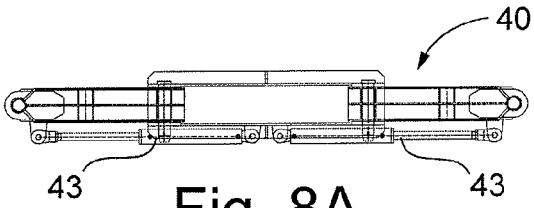
FIGS. 8A and 8B show in detail the actuators adapted to compress/extend the rear bars.
Figure 8B:
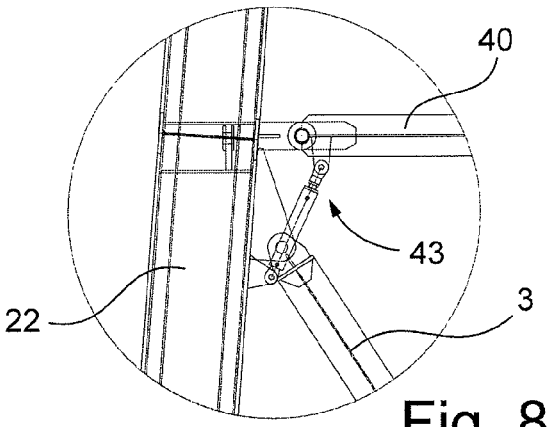

In particular, for rear bars 40 comprised in the lower portion of mast 2, said at least one actuator 43 is constrained at one end to said U-shaped structure, and at the opposite end to a latticed structure 22. Preferably, two actuators 43 arranged at the ends of bar 40 contribute to the compression of bar 40. In the preferred embodiment, said actuator 43 is a hydraulic or pneumatic cylinder, as shown in FIG. 8B. For rear bars 40 comprised in the upper portion of mast 2, said at least one actuator is constrained to the telescopic elements of bar 40 itself, so as to allow for mutual telescopic sliding of the elements of bar 40. Preferably, there are two actuators 43, e.g. two hydraulic or pneumatic cylinders, each connected at one end to the fixed portion of the telescopic element of bar 40 and at the opposite end to the respective ends of bar 40 itself, as shown in FIG. 8A.

The last U-shaped structure in the lowest potion of mast comprises diagonal bars 31, which are connected to base structure 10 when mast 2 is assembled to drilling rig 1. Preferably, as shown in the drawings, there are two diagonal bars 31, each constrained at one end to latticed structure 22, e.g. to a rear leg of the corresponding latticed structure, and at the opposite end to base structure 10, thus arranging themselves into a "V" shape.

When said diagonal bars 31 are released, they are arranged parallel to at least one leg of latticed structure 22 to which they are constrained.

In summary, mast 2 according to the present invention can essentially take two distinct operating configurations, in particular:

open configuration;

closed configuration.

Mast 2 in the open configuration has rear bars 40 extended and constrained, and diagonal members 3 suitably constrained as well, so as to obtain the maximum transversal dimension of the rear face or back 2*a*. This operating configuration is the one normally used during the drilling operations.

Mast 2 in the closed configuration has rear bars 40 compressed and diagonal members 3 split and reduced in size, so as to reduce the transversal dimension of the rear face or back 2*a* of mast 2. This operating configuration is the one normally employed when transporting the mast to a new drilling site. Advantageously, in such a configuration the maximum transversal dimension of back 2*a* is approximately 3.3 m, as required for transportation on two-way two-lane roads.

In order to switch from the open operating configuration to the closed operating configuration, the following consecutive steps are carried out:

splitting diagonal members 3 and reducing the longitudinal extension thereof;

compressing rear bars 40;

bringing latticed structures 22 near each other.

During the splitting and reduction step, splittable diagonal members 3 are divided into sections, whereas the telescopic diagonal members are contracted.

In particular, constraining member 32 is released on splittable diagonal members 3, e.g. by extracting the pins of a double hinge.

During the step of compressing rear bars 40, bars 40 in the upper portion of mast 2 are contracted telescopically, whereas bars 40 in the lower portion of mast 2 are compressed in an accordion-like fashion. To allow bar 40 to be articulated and compressed, hinge points 401 are suitably released.

During said step, actuators 43 contribute to the compression of rear bars 40, thus preventing said bar 40 from getting stuck as it is being compressed, which might cause damage to whole mast 2.

Preferably, as regards the portion of mast 2 where rear bars 40 and telescopic diagonal members 3 are arranged, the splitting, reduction and compression steps are carried out at the same time.

Finally, during the step of bringing latticed structures 22 near each other, said structures 22 are moved towards each other by handling means, thereby setting mast 2 into the closed operating configuration.

In order to switch from the closed operating configuration to the open operating configuration, the following consecutive steps are carried out:

moving latticed structures 22 away from each other;

extending rear bars 40;

reconnecting and increasing the longitudinal dimension of diagonal members 3.

During the step of moving latticed structures 22 away from each other, said structures 22 are moved away from each other by handling means.

During the step of extending rear bars 40, bars 40 in the upper portion of mast 2 are extended telescopically, e.g. by means of actuator 43; bars 40 in the lower portion of mast 2 are extended to assume a substantially straight shape, and hinge points 401 are suitably constrained, thereby preventing rear bar 40 from being unintentionally compressed.

Finally, during the reconnecting and increasing step, the two portions 3*a* and 3*b* of splittable diagonal members 3 are reconnected and appropriately constrained, whereas telescopic diagonal members 3 are extended, thereby setting mast 2 into the open configuration.

Preferably, the portion of mast 2 where telescopic rear bars 40 and diagonal members 3 are arranged, the steps of extending the rear bars and of reconnecting and increasing the dimension of the diagonal members are carried out at the same time.

In an alternative embodiment, said mast 2 can be divided into a plurality of sections which, when in use, are removably constrained to each other.

As shown in FIGS. 4A, 4B, 5A, 5B, 6A, 6B, 7A, 7B, said mast 2 can be divided into four sections, in particular: an upper section 20*a*; an upper intermediate section 20*b*, a lower intermediate section 20*c*, a lower section 20*d*.

In said upper section 20*a* of mast 2 there is handling system 12. Latticed structures 22 are hinged at one end to the structure of at least one crown block comprised in handling system 12, while at the opposite end they comprise connectors 221, preferably of the double-hinge type, which are adapted to connect said section 20*a* to the upper intermediate section 20*b*.

Diagonal members 3 and rear bars 40 comprised in back 2*a* are telescopic and have two fastening positions for the connection to latticed structures 22.

In the closed operating configuration, inside upper section 20*a* there are a plurality of pulleys of at least one travelling block comprised in handling system 12, and the backup line spooler is secured to a latticed structure 22, e.g. to a leg thereof. This avoids the time-consuming task of removing the line from handling system 12.

Preferably, said handling system comprises: at least one drawworks, at least one crown block, at least one travelling block, at least one drilling line, at least one dead line anchor, and at least one backup spooler.

Upper intermediate section 20*b* comprises, at each end of latticed structures 22, connectors 221, e.g. of the double-hinge type, for the connection to the rear section 2*a* and to the upper intermediate section 2*b*.

As aforementioned, rear bars 40 comprise five elements interconnected through said hinge points 401, which, when loosened up, take an accordion-like shape in the closed operating configuration of the mast. Diagonal members 3 are constrained at their ends, e.g. to the U-shaped structures, by means of a hinge, whereas at the centre the two sections are connected through at least one constraining member 32.

In the closed operating configuration, said constraining members 32 are disconnected, thereby releasing the two portions 3*a* and 3*b*. Said released portions 3*a* and 3*b* are preferably arranged, in the closed operating configuration, parallel to latticed structure 22 to which the single portion is constrained, e.g. a leg.

The principle of operation of the lower intermediate section 20*c* is substantially similar to the above-mentioned upper intermediate section 2*b*.

For the purposes of the present invention, the statement that the principle of operation is substantially similar means that the U-shaped structures and diagonal members 3 comprised in different sections of mast 2 have the same principle of operation, even though their structural dimensions are different.

Lower section 20*d*, whose principle of operation is substantially similar to that of the preceding intermediate sections (20*b*, 20*c*), additionally comprises two diagonal bars 31, each secured at one end to at least one latticed structure 22, e.g. a leg, and at the opposite end to base structure 10, thus assuming as a whole a "V" shape.

The steps for switching mast 2 from the open configuration to the closed configuration may comprise one or more sectioning steps, which can be carried out either before the division and reduction step or after the step of bringing latticed structures 22 near each other.

On the other hand, the steps for switching mast 2 from the closed configuration to the open configuration may comprise one or more steps of connecting together two or more sections; said steps can be carried out either before the step of moving latticed structures 22 mutually away from each other or after the step of reconnecting and increasing the longitudinal dimension of diagonal members 3.

The method of assembling mast 2 according to the present invention to a drilling rig 1 comprises the following steps:

- positioning base structure 10 over the drilling site "P" and positioning at least two support trestles 18;
- connecting the plurality of sections (20*a*, 30*b*, 20*c*, 20*d*), placed on said at least two trestles 18, in order to assemble mast 2 in a closed operating configuration;
- extending rear face 2*a* of mast 2 to obtain an open operating configuration;
- lifting mast 2 to a height "Z2" from the ground "S", at the same level as the base structure;
- bringing mast 2 near base structure 10;
- fixing mast 1 to base structure 10;
- erecting mast 1 vertically over drilling site "P".

Said steps are preferably carried out sequentially.

Figure 9A:
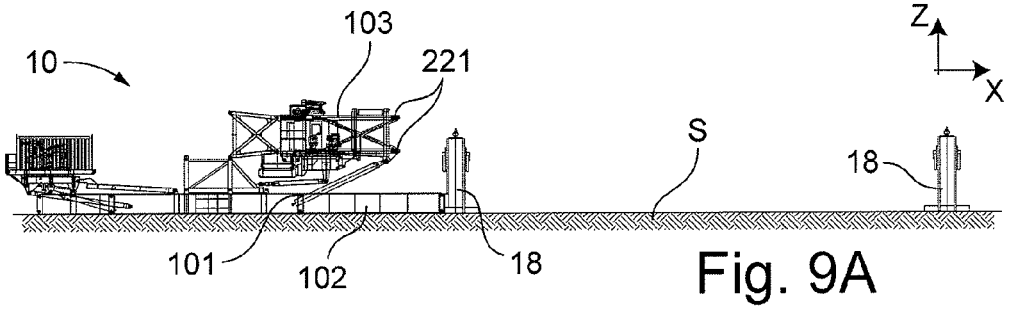

Said steps are illustrated, in a preferred embodiment, in FIGS. 9A÷9J and 4A, 4B, 5A, 5B, 6A, 6B, 7A, 7B.

Said mast 1, as aforementioned, is formed by two side faces 2*b* and one rear face 2*a*, which can be closed. Said mast 2 is constrained, when in use, to a base structure 10.

Said base structure 10 comprises a plurality of support members or sub-base 102, a plurality of connection crosspieces, a central structure, a three-sided latticed structure 103, and at least one lifting means 101 for lifting mast 2 from a position substantially parallel to ground "S" to a position substantially vertical over base structure 10.

For the purposes of the present invention, the expression "substantially horizontal" means that the longitudinal axis of mast 2 has an angle of inclination relative to ground "S" of less than 6°, whereas the expression "substantially vertical" means that the longitudinal axis of mast 2 has an angle of inclination relative to the normal to the surface of ground "S" within ±6°.

During the step of positioning base structure 10, the plurality of elements comprised in base structure 10 are mounted by using cranes in accordance with traditional methods. In particular, for example, the support members or sub-base 102 and the connection crosspieces are first positioned, and then the central structure and the three-sided latticed structure 103 are installed, the latter being arranged in a horizontal position, parallel to ground "S", at a predetermined height "Z2" from the ground, to which mast 2 will be secured. Said three-sided latticed structure 103 is preferably hinged at one end, and is supported by said at least one lifting means 101, e.g. a plurality of hydraulic pistons.

Preferably, the support members or sub-base 102 are mounted in such a way as to reach lifting means 101. The greater extension of the support members or sub-base 101 will ensure better stability of base structure 10 and of mast 2 during the next step of erecting mast 2.

During said positioning step, at least two trestles 18 are also positioned, preferably a first trestle 18', placed proximal to base structure 10, e.g. near the end of the extension of sub-base 102, and a second trestle 18", placed at a distance from said first trestle 18', which is shorter than the maximum extension of mast 2, preferably substantially matching the longitudinal extension of mast 2 from the centre of lower section 20*d* to the centre of upper section 20*a*.

The positioning step is followed by the step of connecting the plurality of sections (20*a*, 20*b*, 20*c*, 20*d*). Preferably, said sections (20*a*, 20*b*, 20*c*, 20*d*) are initially positioned and fastened by positioning the lower section 20*d* on said first trestle 18', and then positioning the lower intermediate section 20*c* near lower section 20*d* and connecting it to the same lower section 20*d* through the above-mentioned connectors 221. Said sections (20*a*, 20*b*, 20*c*, 20*d*) are at least partly supported by at least one carriage adapted to support sections (20*a*, 20*b*, 20*c*, 20*d*) while assembling the mast 2.

Figure 9B:
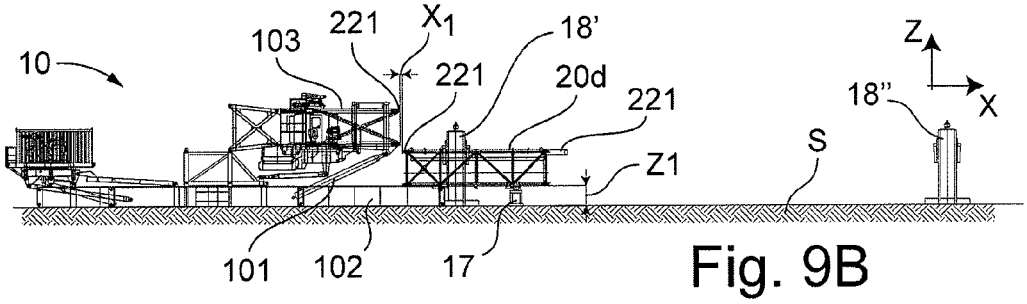
Figure 9C:
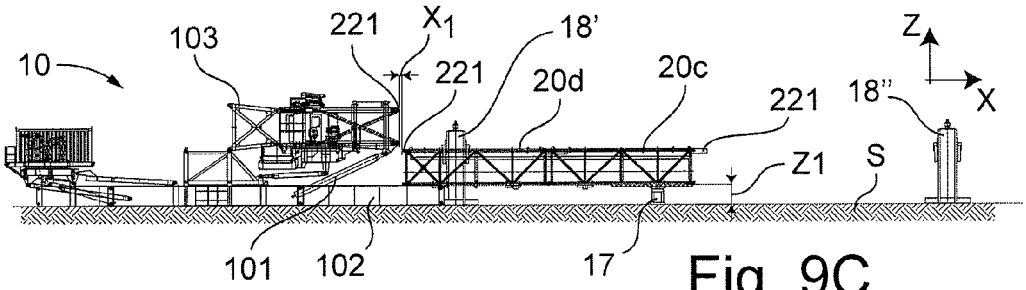
Figure 9D:
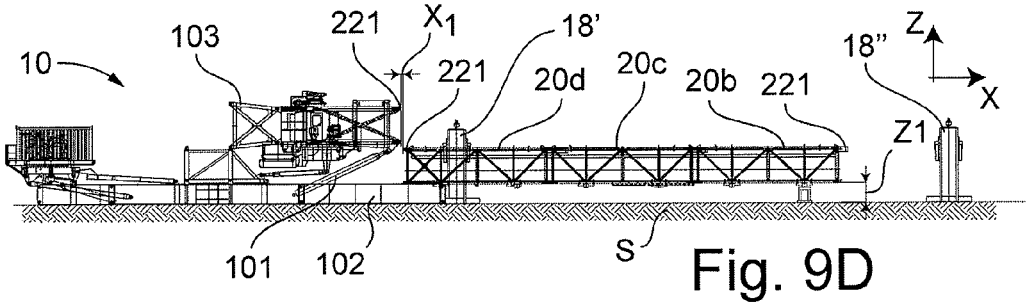

Upper intermediate section 20*b* and upper section 20*a* are then positioned and finally interconnected in the same manner, thus completing the assembly of mast 2, as shown in FIGS. 9B÷9E).

Preferably, lower section 20*d* is placed on first trestle 18' in a manner such that lowest U-shaped structure, comprised in same lower section 20*d*, is in the proximity of said trestle 18'.

For the purposes of the present invention, the term "lowest U-shaped structure" refers to that U-shaped structure, comprised in mast 2, which is closest, when in use, to the base structure 10.

Preferably, upper U-shaped structure comprised in upper section 20*a* is placed on second trestle 18".

For the purposes of the present invention, the term "upper U-shaped structure" refers to that U-shaped structure, comprised in mast 2, which is closest, when in use, to handling system 12.

Preferably, prior to connecting upper section 20*a* to upper intermediate section 20*b*, there is a further step of preparing handling system 12, wherein the line spooler is separated from the legs of latticed structures 22 and is positioned beside mast 2, where the line is then unwound.

Preferably, the connection of the plurality of sections (20*a*, 20*b*, 20*c*, 20*d*) occurs at a first height "Z1" from the surface of ground "S", lower than the above-mentioned height "Z2", so that mast 2 is assembled horizontally, i.e. parallel to ground "S".

Assembling mast 2 at height "Z1" allows the personnel in charge to easily work on said mast 2.

For the purposes of the present invention, the expression "mast 2 is assembled horizontally" means that mast 2, by means of said support trestles 18, is assembled parallel to ground "S" where said drilling rig 1 is being assembled.

Figure 9E:
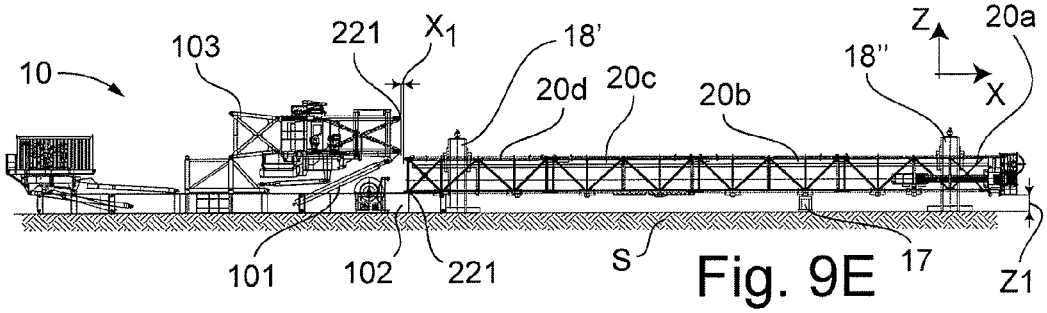

Preferably, mast 2 is placed at a first height "Z1" from ground "S" which is equal to, for example, approximately 1.5 m, as shown in FIG. 9E.

Once mast 2 has been assembled by connecting together the various mast sections (20*a*, 20*b*, 20*c*, 20*d*), the next step of extending rear face 2*a* of mast 2 is carried out.

During said extension step, mast 2 switches from the closed operating configuration to the open operating configuration. Preferably, in order to switch from the closed operating configuration to the open one, the above-mentioned steps for opening mast 2 are carried out.

The step of extending rear face 2*a* of mast 2 is followed by the step of lifting mast 2 to the height "Z2" from ground "S". In this step mast 2, which is kept parallel to ground "S", is lifted from initial height "Z1" to height "Z2" as shown in FIGS. 9E and 9F. In fact, as aforementioned, said height "Z2" is where the three-sided latticed structure 103 is located. Preferably, said height "Z2" is approximately 4 m above ground "S".

The lifting step is followed by the step of bringing mast 2 near base structure 10; in fact, in order to further facilitate the assembly of mast 2, the first trestle 18' is arranged in a manner such that connectors 221 comprised in lower section 20*d* of mast 2 are at a predetermined distance "X1" from matching connectors 221 of base structure 10, as shown in FIGS. 9B÷9E.

Said predetermined distance "X1", e.g. approximately 0.5 m, prevents mast 2 from abutting against base structure 10 during the step of lifting mast 2 from height "Z1" to height "Z2". Moreover, setting mast 2 at the predetermined distance "X1" from base structure 10 facilitates the assembly operations carried out by the personnel in charge. By setting back mast 2 by distance "X1" it is possible to perfectly match connectors 221 of base structure 10 with the connectors 221 of lower section 20*d* of mast 2.

Preferably, the above-mentioned steps of extending, lifting and bringing near are carried out by means of said at least two support trestles 18; in fact, said trestles 18 are adapted to extend, lift and bring mast 2 near base structure 10.

Said trestles 18 comprise a plurality of actuators adapted to handle the mast, in a predetermined manner, in the orthogonal space defined by axes "X", "Y" and "Z" orthogonal to each other. Said trestles 19 comprise a plurality of brackets (not shown) for constraining the latticed structures 22 of the mast, in order to allow mast 2 to be switched from the closed operating configuration to the open operating configuration.

Said actuators, comprised in each trestle 18, are preferably hydraulic pistons, preferably arranged in a manner such that at least one acts along axis "X", at least one acts along axis "Y", and at least one acts along axis "Z".

The step of bringing near is followed by the step of fixing mast 2 to base structure 10 through connectors 221.

Finally, the step of erecting mast 2 is carried out through said lifting means 101, switching from a position parallel to ground "S" to a vertical position, perpendicular to ground "S", over base structure 10.

Advantageously, after the step of bringing near mast 2 and before the step of erecting mast 2, the following steps are carried out in order to assemble handling system 12:

unwinding the line from a spooler towards the drawworks, by passing the line through the crown block and the traveling block and then securing it to the drawworks drum.

rotating the drum and simultaneously releasing the line from the spooler, thus filling the drawworks drum.

fastening a dead line anchor to base structure 10;

returning the travelling block to the mast base through an auxiliary drawworks and simultaneously releasing the line from the main drawworks. The shifting of the weight of the travelling block towards the mast base facilitates the lifting operation and improves the stability of the system. It is also possible to install top drive 14 in lower section 20*d* of mast 2 while still leaving it secured to vertical beam 16 for guiding top drive 14 itself, so as to prevent it from moving during the next step of erecting mast 2.

After the step of returning the travelling block, there is a further step of deploying the "tubing board" and the "racking board", followed by the connection of the lifting power unit.

The architecture of mast 2 according to the present invention facilitates and reduces the operations necessary for assembling/disassembling the mast itself, while reducing transportation costs because the overall dimension does not exceed the prescribed limit for exceptional transportations on two-way roads requiring an escort from the road authorities, e.g. the highway police.

Advantageously, in poorly urbanized areas mast 2 according to the present invention can be transported as a whole in the vertical position by using special transportation structures. Of course, the distances that can be covered are in such a case of the order of a few miles only. Furthermore, for transportation in areas with lane occupation limits, the width dimension can be reduced by articulating rear face or back 2*a* of mast 2. Entire mast 2 can thus be transported with a reduced transversal dimension of back 2*a*.

In order to facilitate transportation even further, said mast can be divided into sections.

The elements that constitute the mast according to the present invention allow to quickly switch between the two above-mentioned operating configurations, thereby reducing the time necessary for assembling the whole drilling rig and requiring a reduced manual contribution for such operations compared to prior-art masts.

Furthermore, the use of the above-mentioned trestles 18 allows to speed up the operations for assembling the mast to drilling rig 1. The use of trestles 18 in combination with mast 2 according to the present invention significantly speeds up the assembly of the drilling rig, in that many assembling steps are simplified and automated.

The invention claimed is:

1. A reclosable mast for a drilling rig, said mast comprising:

two opposed latticed structures constrained at one end to a base structure placed on a drilling site, and at an opposite end to each other, defining side faces of the mast;

a plurality of U-shaped structures, each U-shaped structure comprising a rear bar which is compressed when closing the mast, and two side shoulders parallel to each other and perpendicular to said bar with which the side shoulders are associated;

said U-shaped structures are arranged at preset intervals between the two latticed structures, so that said rear bars define a rear face or back of the mast;

wherein when closing the mast:

a first diagonal member is split into at least two portions disconnected at a center thereof and including at least one constraining member, the constraining member being adapted to:

removably fix said at least two portions of the first diagonal member when in use, and be disconnected when the mast is closed;

a second diagonal member reduced in a longitudinal direction telescopically.

2. The mast according to claim 1, wherein said rear bar of each U-shaped structure is articulated and comprises at least three hinge points adapted to allow for accordion-type compression of the bar when closing the mast, the compressed bar being arranged on the surface defined by the rear face of the mast.

3. The mast according to claim 2, wherein said hinge points comprise six hinge points.

4. The mast according to claim 1, wherein said rear bar is telescopic and is adapted to be compressed when closing the mast.

5. The mast according to claim 1, wherein at least one actuator, adapted to contribute to the extension of the rear bar for opening the mast, is associated with each U-shaped structure, being constrained at one end to said U-shaped structure and at an opposite end to a latticed structure.

6. The mast according to claim 5, wherein the at least one actuator is a hydraulic or pneumatic piston.

7. The mast according to claim 1, wherein said mast is divided into a plurality of sections, which are mutually constrained in a removable manner.

8. The mast according to claim 7, wherein said plurality of sections comprise at least four sections.

9. A method of assembling a reclosable mast of claim 1 for use in a drilling rig, wherein said mast, formed by two side faces and one reclosable rear face, is constrained, when in use, to a base structure, which in turn comprises means for lifting the mast, which are adapted to lift said mast from a position substantially parallel to the ground to a substantially vertical position on the base structure, said mast comprising:

a plurality of sections, which can be mutually constrained in a removable manner;

the method comprising the following steps:

positioning said base structure over a drilling site and positioning at least two support trestles;

connecting said plurality of sections, placed on said at least two trestles, to assemble said mast in a closed operating configuration;

extending the rear face of the mast to obtain an open operating configuration;

lifting the mast to a height from the ground;

bringing the mast proximate the base structure;

fixing the mast to the base structure; and erecting the mast vertically over the drilling site.

10. The method according to claim 9, wherein at least one first trestle is placed proximal to the base structure, and at least one second trestle is placed at a distance from said first trestle which is shorter than a longitudinal extension of said mast.

11. The method according to claim 9, wherein the connection of the plurality of sections, during the step of connecting the plurality of sections, takes place at a height from the ground which is lower than 2 m, so that said mast is assembled horizontally, parallel to the ground.

12. The method according to claim 9, wherein the step of extending, the step of lifting and the step of bringing proximate are carried out by said at least two support trestles, which are adapted to extend, lift and bring the mast proximate the base structure.

13. The method according to claim 12, wherein said at least two trestles comprise a plurality of actuators adapted to handle the mast, in a predetermined manner, in an orthogonal space defined by three axes orthogonal to each other.

14. The method according to claim 9, wherein said lifting means are hydraulic pistons.

15. A reclosable mast for a drilling rig, said mast comprising:

two opposed latticed structures constrained at one end to a base structure placed on a drilling site, and at an opposite end to each other, defining side faces of the mast;

a plurality of U-shaped structures, each U-shaped structure comprising a rear bar which is compressed when closing the mast, and two side shoulders parallel to each other and perpendicular to said bar with which the side shoulders are associated;

said U-shaped structures are arranged at preset intervals between the two latticed structures, so that said rear bars define a rear face or back of the mast;

a plurality of diagonal members, located on the rear face of the mast and constrained, when in use, between two of said U-shaped structures to reduce a transverse dimension of the rear face of the mast;

at least one actuator associated with each U-shaped structure, each actuator being adapted to contribute to extension and compression of the rear bar of an associated U-shaped structure for opening and closing the mast; each actuator being constrained at a first end to the rear bar of the associated U-shaped structure and at an opposite end to an opposed one of the latticed structures;

wherein when closing the mast:

a first diagonal member is split into at least two portions disconnected at a center thereof and including at least one constraining member, the constraining member being adapted to:

removably fix said at least two portions of the first diagonal member when in use, and be disconnected when the mast is closed;

a second diagonal member reduced in a longitudinal direction telescopically.

* * * * *